US007296456B2

(12) United States Patent
Ushida

(10) Patent No.: US 7,296,456 B2
(45) Date of Patent: Nov. 20, 2007

(54) METHODS AND APPARATUS FOR MANUFACTURING FLANGED ARTICLES

(75) Inventor: Kouhei Ushida, Okazaki (JP)

(73) Assignee: Araco Kabushiki Kaisha, Aichi-ken (JP)

( * ) Notice: Subject to any disclaimer, the term of this patent is extended or adjusted under 35 U.S.C. 154(b) by 253 days.

(21) Appl. No.: 10/801,904

(22) Filed: Mar. 16, 2004

(65) Prior Publication Data

US 2004/0187547 A1 Sep. 30, 2004

(30) Foreign Application Priority Data

Mar. 26, 2003 (JP) ..... 2003-085495
Aug. 29, 2003 (JP) ..... 2003-306516

(51) Int. Cl.
*B21D 22/00* (2006.01)

(52) U.S. Cl. ..... 72/356; 72/335; 72/351; 72/335.2

(58) Field of Classification Search ..... 29/893.32, 29/893.36; 72/324, 327, 329, 333, 274, 336, 72/352, 356, 358, 359, 377, 335, 350, 351, 72/353.2, 355.2, 355.6, 360
See application file for complete search history.

(56) References Cited

U.S. PATENT DOCUMENTS 1,434,190 A 10/1922 Bird
2,654,944 A 10/1953 Wilson
5,068,964 A 12/1991 Yabuno et al.
5,152,061 A 10/1992 Himmeroeder
5,237,745 A 8/1993 Yamanaka
5,651,181 A * 7/1997 Shohara et al. ..... 29/892.3
5,878,493 A * 3/1999 Himmeroeder ..... 29/893.35
5,904,060 A * 5/1999 Kanemitsu et al. ..... 72/110
6,014,806 A 1/2000 Ohya
6,016,602 A 1/2000 Kanemitsu et al.
6,330,836 B1 12/2001 Watanabe et al.
6,907,764 B2 * 6/2005 Ushida ..... 72/327

FOREIGN PATENT DOCUMENTS

DE 19723073 12/1998
JP 11-320021 11/1999
JP 2003-103328 4/2003
WO WO 9622847 8/1996

* cited by examiner

*Primary Examiner*—Derris H. Banks
*Assistant Examiner*—Debra M Wolfe
(74) *Attorney, Agent, or Firm*—Patterson, Thuente, Skaar & Christensen, P.A.

(57) ABSTRACT

A method for manufacturing an article (420) having a peripheral portion (422) may include reverse squeezing an initial peripheral portion (22) of an initial article (20) to form a first intermediate article (12) having a first intermediate peripheral portion (122) that is partly thinned, and squeezing the first intermediate peripheral portion (122) of the first intermediate article (120) to form a second intermediate article (220) having a second intermediate peripheral portion (222) that is thickened throughout.

8 Claims, 15 Drawing Sheets

METHODS AND APPARATUS FOR MANUFACTURING FLANGED ARTICLES

BACKGROUND OF THE INVENTION

1. Technical Field

The present invention relates to methods and apparatus for manufacturing an article having a peripheral portion (hereinafter referred to as "flanged article") from a sheet material.

2. Related Art

A known method for manufacturing a flanged article that comprises a central depressed body coupled to a peripheral flange is taught, for example, by U.S. patent application Ser. No. 10/103328, in which a material (e.g., a sheet material or a sheet blank) is placed and clamped between upper and lower dies of a press forming device and is then press formed or half die cut, to thereby form an intermediate flanged article that comprises a central depressed body and a peripheral flange. Thereafter, the intermediate flanged article thus formed is then processed by utilizing a squeezing device having upper and lower dies. That is, the intermediate flanged article is clamped between the upper and lower dies so that the peripheral flange is clamped between a clamp ring of the upper die and a piston of the lower die. At this time, the peripheral flange of the intermediate flanged article preferably projects or extends radially outwardly from the piston and the clamp ring, to thereby define an annular extending portion around the peripheral flange. Thereafter, the clamp ring and the punch will be pushed into a die opening of the lower die together with the piston. Consequently, the annular extending portion of the peripheral flange will be radially inwardly squeezed or compressed and the peripheral flange will thicken as a result of plastic flow caused by plastic deformation. Thus, the flanged article having the thickened peripheral flange is produced as the secondary product or final product. Unfortunately, previously known methods has a tendency to squeeze out during the operation to thicken the peripheral flange. The peripheral flange itself could end up uneven in regards to thickness based upon variations resulting from the squeezing out of material.

SUMMARY OF THE INVENTION

It is, accordingly, one object of the present teachings to provide improved methods and apparatus for manufacturing flanged articles.

For example, in one aspect of the present teachings, a method for manufacturing an article having a peripheral portion may include reverse squeezing an initial peripheral portion of an initial article to form a first intermediate article having a first intermediate peripheral portion that is partly thinned, and squeezing the first intermediate peripheral portion of the first intermediate article to form a second intermediate article having a second intermediate peripheral portion that is thickened throughout.

According to the present teachings, because the first intermediate peripheral portion is partly thinned, the first intermediate peripheral portion of the first intermediate article may effectively radially inwardly move by plastic deformation without substantially squeezing out when squeezed. As a result, the first intermediate peripheral portion can be effectively thickened so that the second intermediate article has the second intermediate peripheral portion that is reliably and evenly thickened throughout.

Further, the reverse squeezing operation is defined as a preliminary processing that is performed prior to the squeezing operation. Typically, the reverse squeezing operation is defined as a compressing operation for compressing the initial peripheral portion of the initial article in the opposite direction of the squeezing operation.

Other objects, features and advantages of the present invention will be ready understood after reading the following detailed description together with the accompanying drawings and the claims.

DETAILED DESCRIPTION OF THE INVENTION

Figure 1:
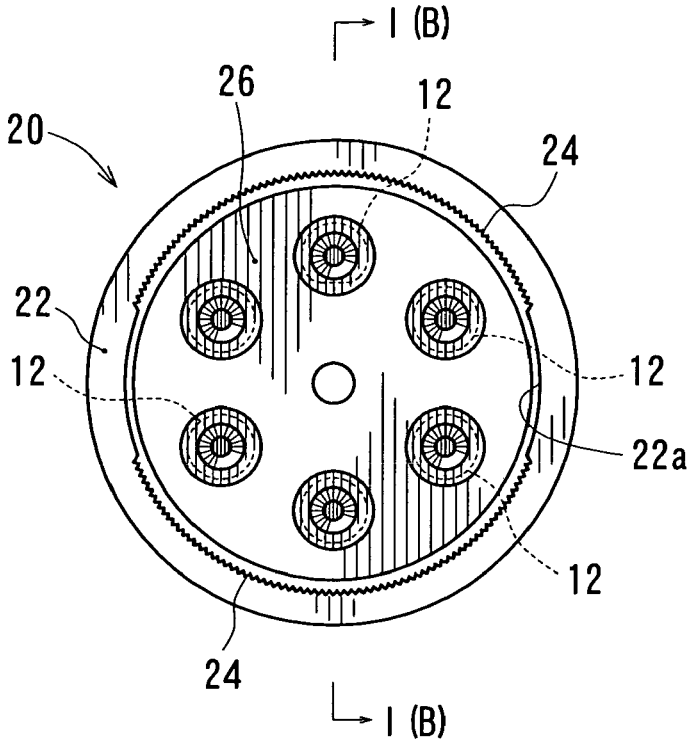
FIG. 1(A) is a plan view of an initial recessed plate according to one representative embodiment of the present teachings.
FIG. 1(B) is a cross-sectional view taken along line I(B)-I(B) in FIG. 1(A)
FIG. 1(C) is a partially enlarged view of FIG. 1(B)
Figure 1:
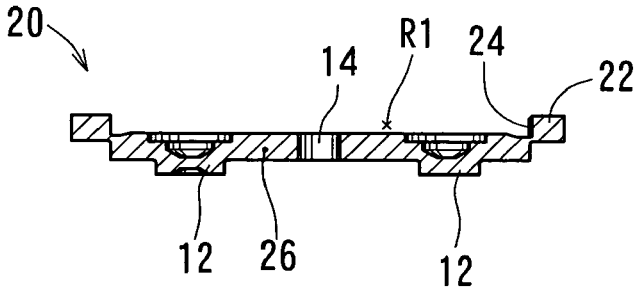
Figure 1:
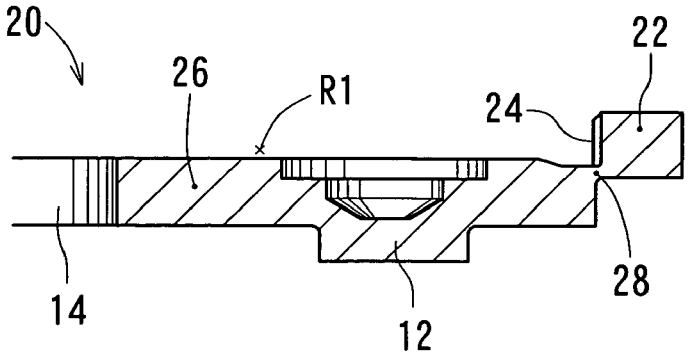
Figure 4:
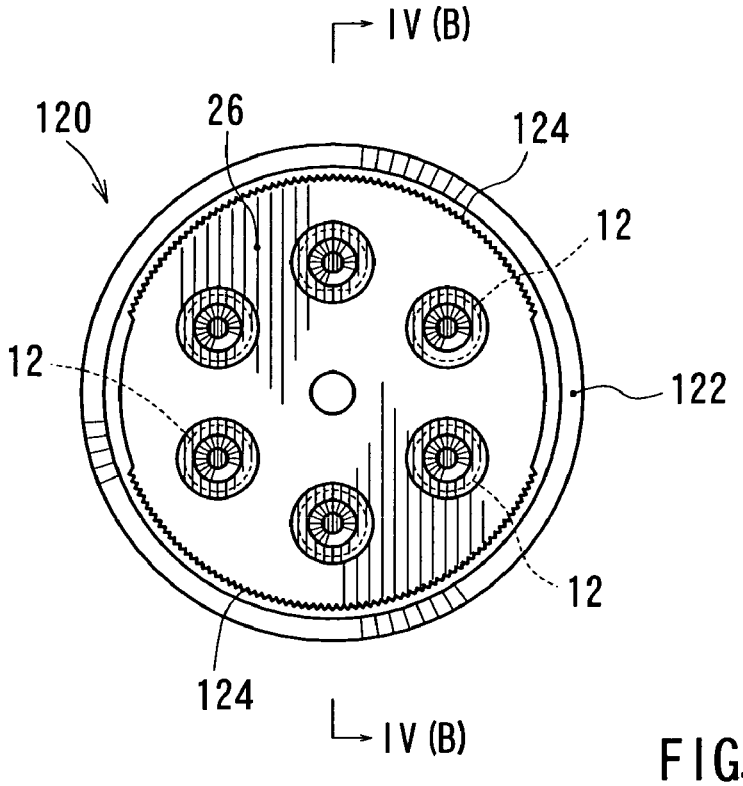
FIG. 4(A) is a plan view of a first intermediate recessed plate according to the representative embodiment of the present teachings.
FIG. 4(B) is a cross-sectional view taken along line IV(B)-IV(B) in FIG. 4(A)
FIG. 4(C) is a partially enlarged view of FIG. 4(B)
Figure 4:
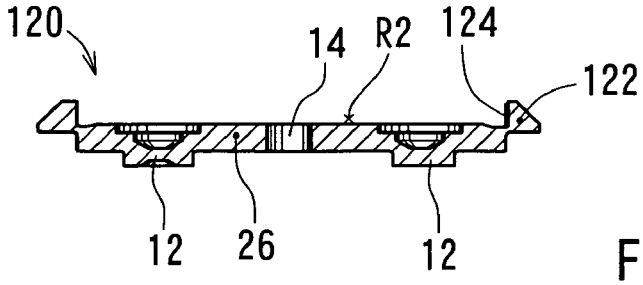
Figure 4:
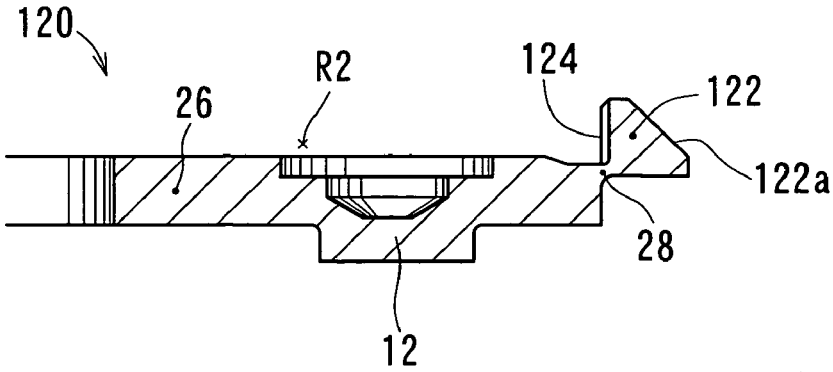
Figure 7:
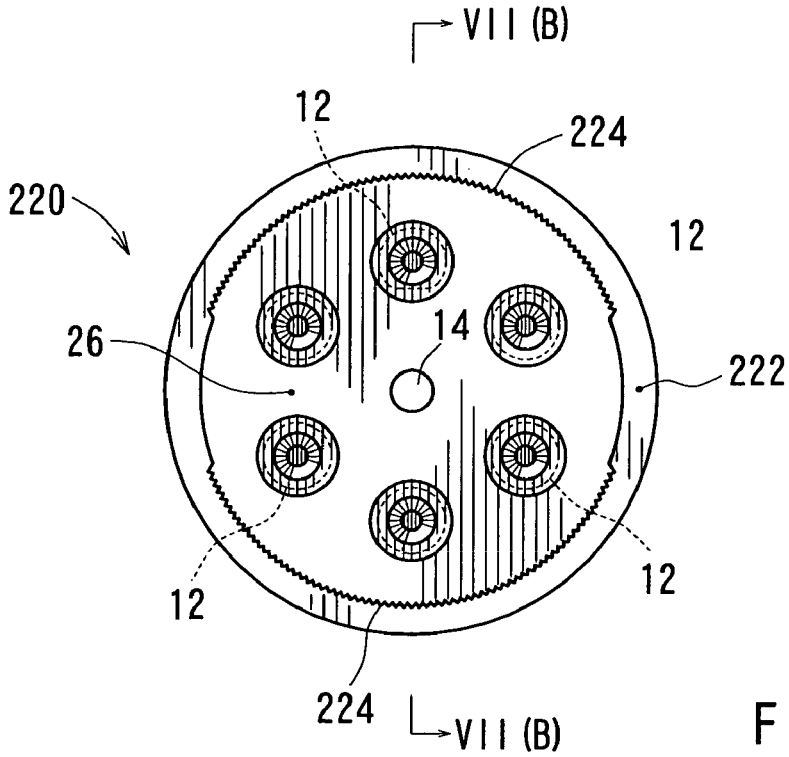
FIG. 7(A) is a plan view of a second intermediate recessed plate according to the representative embodiment of the present teachings.
FIG. 7(B) is a cross-sectional view taken along line VII(B)-VII(B) in FIG. 7(A)
FIG. 7(C) is a partially enlarged view of FIG. 7(B)
Figure 7:
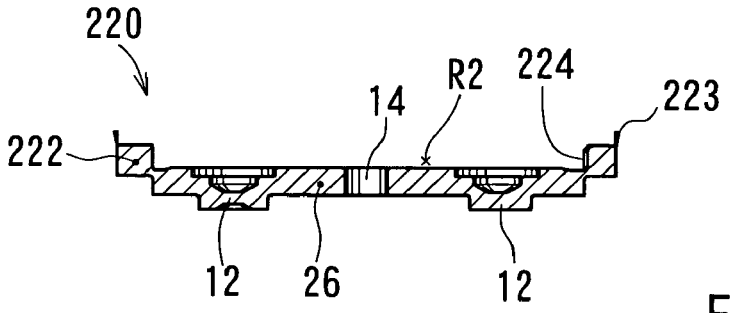
Figure 7:
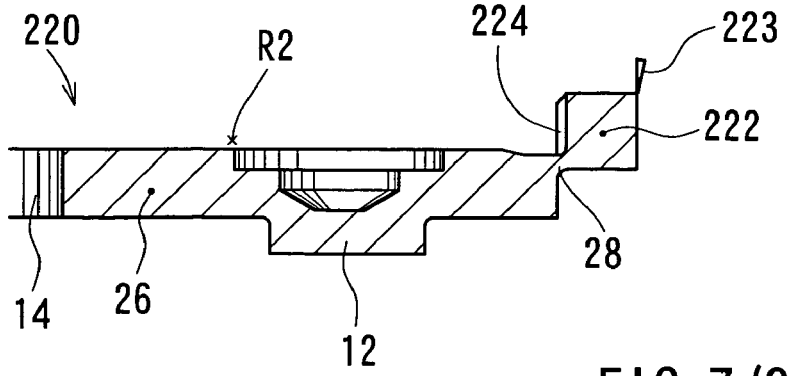
Figure 10:
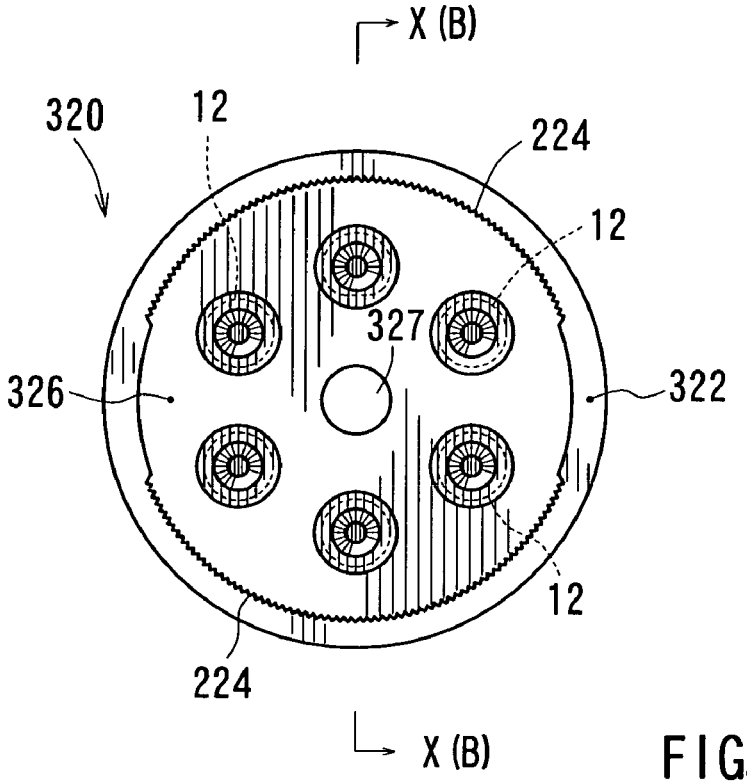
FIG. 10(A) is a plan view of a third intermediate recessed plate according to the representative embodiment of the present teachings.
FIG. 10(B) is a cross-sectional view taken along line X(B)-X(B) in FIG. 10(A)
FIG. 10(C) is a partially enlarged view of FIG. 10(B)
Figure 10:
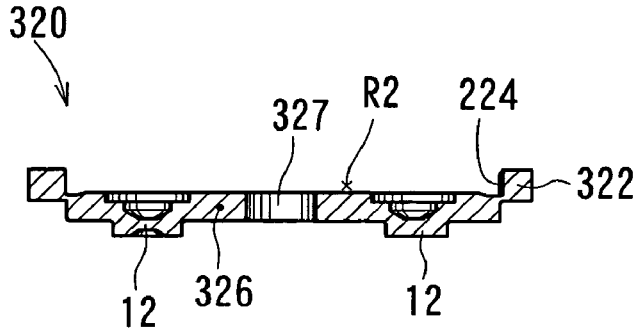
Figure 10:
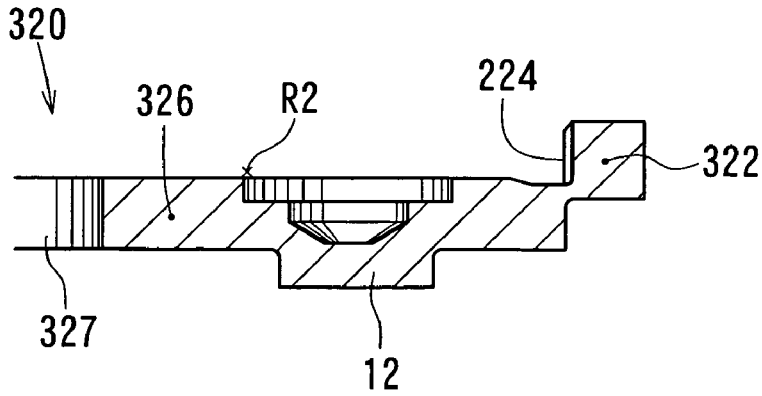
Figure 13:
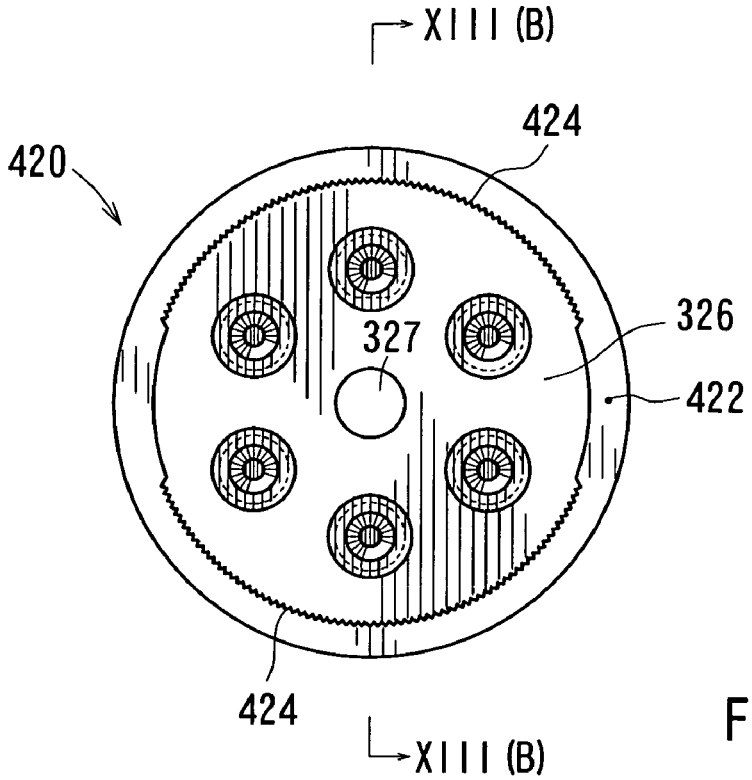
FIG. 13(A) is a plan view of a final recessed plate according to the representative embodiment of the present teachings.
FIG. 13(B) is a cross-sectional view taken along line XIII(B)-XIII(B) in FIG. 13(A)
FIG. 13(C) is a partially enlarged view of FIG. 13(B)
Figure 13:
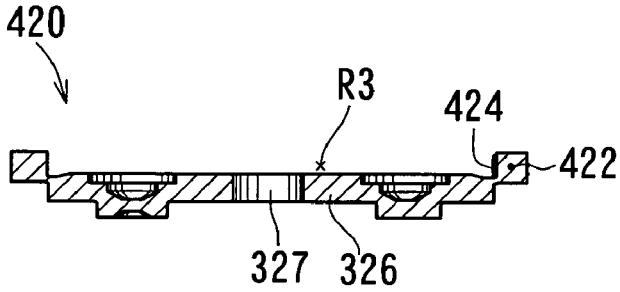
Figure 13:
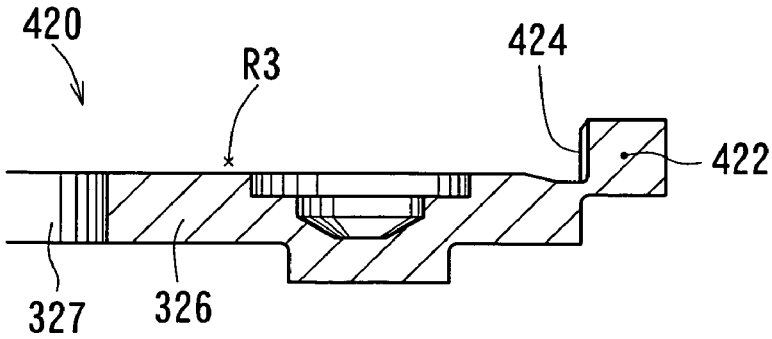

A detailed representative embodiment of the present teachings is shown in FIGS. 1(A) to 15(B), in which a circular dish-like toothed recessed plate 420 (FIG. 13(A)) is exemplified as a flanged article that can be prepared utilizing the present teachings. The recessed plate (i.e., final recessed plate) 420 is preferably formed by successively processing a previously formed, initial toothed recessed plate 20, which is shown in FIG. 1(A). That is, the recessed plate 420 is preferably formed through first to third intermediate toothed recessed plates 120 (FIG. 4(A)), 220 (FIG. 7(A)) and 320 (FIG. 10(A)) from the initial toothed recessed plate 20.

Further, such a recessed plate 420 may be utilized, e.g., with a housing that defines a locking mechanism for a vehicle seat reclining device.

As shown in FIGS. 1(A)-1(C), the initial recessed plate 20 as a primary product may preferably be formed by half die cutting a circular sheet material or sheet blank 10 (FIG. 3(A)). That is, the initial recessed plate 20 may preferably be formed from the sheet material 10 by a shear press forming operation. The initial recessed plate 20 thus formed may have a central circular depressed body (offset portion) 26 and an initial annular peripheral flange (i.e., an initial annular peripheral portion) 22 having a rectangular cross-sectional shape. The peripheral flange 22 is integrally and continuously connected to the central body 26 via an annular shear deformed connecting portion 28. Consequently, the inner surface of the peripheral flange 22 and the top surface of the central body 26 define a circular open cavity or recess R1. In addition, two opposing toothed portions 24 are defined on an inner circular surface 22*a* of the peripheral flange 22. As shown in FIG. 1(C), the peripheral flange 22 may have substantially the same thickness as the central body 26. Further, the central body 26 may have a central through bore 14 and a plurality of (six in this embodiment) depressed portions or dwells 12. Typically, the central through bore 14 and the dwells 12 may preferably be formed in the sheet material 10.

Although the sheet material 10 may be formed by a variety of known methods, the sheet material 10 is preferably formed by stamping out a metal plate having a desired thickness. As noted above, the metal plate may preferably be a steel plate (e.g., a boron doped carbon steel plate) and known techniques for cold press forming may be utilized with the present teachings.

As shown in FIGS. 4(A)-4(C), the first intermediate recessed plate 120 as a secondary product may preferably be formed by partly processing the initial recessed plate 20. That is, the first intermediate recessed plate 120 may preferably be formed by radially and inwardly deforming (plastic deformation or plastically deforming) the peripheral flange 22 of the initial recessed plate 20 (i.e., by a preliminary or reverse squeezing operation). The first intermediate recessed plate 120 thus produced may have the same construction as the initial recessed plate 20 except for the peripheral flange 22 and the toothed portions 24. As best shown in FIG. 4(C), the first intermediate recessed plate 120 may comprise a first intermediate annular peripheral flange (i.e., a first intermediate annular peripheral portion) 122 having an outer inclined circumferential surface 122*a*. Typically, part of the peripheral flange 122 may be thickened so as to have a thickness greater than that of the peripheral flange 22 of the initial recessed plate 20. Simultaneously, part of the peripheral flange 122 may be thinned so as to have a thickness smaller than that of the peripheral flange 22 of the initial recessed plate 20. Also, the first intermediate recessed plate 120 may comprise toothed portions 124 which are modified from the toothed portions 24 of the initial recessed plate 20. Each of the toothed portions 124 may have a height higher than that of the toothed portion 24 of the initial recessed plate 20.

Further, similar to the initial recessed plate 20, the inner surface of the peripheral flange 122 and the top surface of the central body 26 define a circular open cavity or recess R2. As will be recognized, the recess R2 may have a depth greater than that of the recess R1 of the initial recessed plate 20.

As shown in FIGS. 7(A)-7(C), the second intermediate recessed plate 220 as a tertiary product may preferably be formed by partly processing the first intermediate recessed plate 120. That is, the second intermediate recessed plate 220 may preferably be formed by further radially and inwardly deforming (plastic deformation or plastically deforming) the peripheral flange 122 of the first intermediate recessed plate 120 (i.e., by a squeezing operation). The second intermediate recessed plate 220 thus produced may have the same construction as the first intermediate recessed plate 120 except for the peripheral flange 122 and the toothed portions 124. As best shown in FIG. 7(C), the second intermediate recessed plate 220 may comprise a second intermediate annular peripheral flange (i.e., a second intermediate annular peripheral portion) 222 having a rectangular shape in cross section. That is, the peripheral flange 222 of the second intermediate recessed plate 220 is evenly thickened throughout and does not have any inclined circumferential surface similar to the inclined surface 122*a* of the first intermediate recessed plate 120. Typically, the peripheral flange 222 may have substantially the same thickness as (or a thickness greater than that of) the partly thickened peripheral flange 122 of the first intermediate recessed plate 120. Also, the second intermediate recessed plate 220 may comprise toothed portions 224. Each of the toothed portions 224 may have substantially the same height as (or a height higher than that of) the toothed portion 124 of the first intermediate recessed plate 120. As will be easily understood, the second intermediate recessed plate 220 may have an outer diameter smaller than that of the first intermediate recessed plate 120.

Further, as best shown in FIG. 7(C), the peripheral flange 222 may have upwardly projecting small burrs or flashes 223 which are formed around an upper circumferential periphery during the plastic deformation of the peripheral flange 122 of the first intermediate recessed plate 120.

As shown in FIGS. 10(A)-10(C), the third intermediate recessed plate 320 as a quaternary product may preferably be formed by partly processing the second intermediate recessed plate 220. That is, the third intermediate recessed plate 320 may preferably be formed by circumferentially finishing the peripheral flange 222 of the second intermediate recessed plate 220 (i.e., by a finishing operation) and simultaneously punching the central body 26 thereof along an axis of the central through bore 14. The third intermediate recessed plate 320 thus produced may have the same construction as the second intermediate recessed plate 20 except for a part thereof. That is, the third intermediate recessed plate 320 may preferably comprise a central body 326 and a third intermediate annular peripheral flange (i.e., a third intermediate annular peripheral portion) 322. The central body 326 has an enlarged central through bore 327. The bore 327 is formed by the punching operation and has a diameter greater than that of the central through bore 14. Further, the peripheral flange 322 is substantially identical with the peripheral flange 222 of the second intermediate recessed plate 220 except that the flashes 223 are completely removed.

As shown in FIGS. 13(A)-13(C), the final recessed plate 420 may preferably be formed by partly processing the third intermediate recessed plate 320. That is, the final recessed plate 420 may preferably be formed by vertically pressing the peripheral flange 322 of the third intermediate recessed plate 320 (i.e., by a restriking or coining operation). The final recessed plate 420 thus produced may have the same construction as the third intermediate recessed plate 320 except for the peripheral flange 322 and the toothed portions 324. As best shown in FIG. 13(C), the final recessed plate 420 may have a final annular peripheral flange (i.e., a final annular peripheral portion) 422. As will be appreciated, the peripheral flange 422 may have a desired thickness. Typically, the peripheral flange 422 may have a thickness slightly smaller than that of the peripheral flange 322 of the third intermediate recessed plate 320. Also, the final recessed plate 420 may comprise toothed portions 424. Each of the toothed portions 424 may have a desired height which corresponds to the thickness of the peripheral flange 422.

Further, the inner surface of the peripheral flange 422 and the top surface of the central body 326 define a circular open cavity or recess R3. Typically, the recess R3 may have a depth slightly smaller than that of the recess R2.

Figure 2:
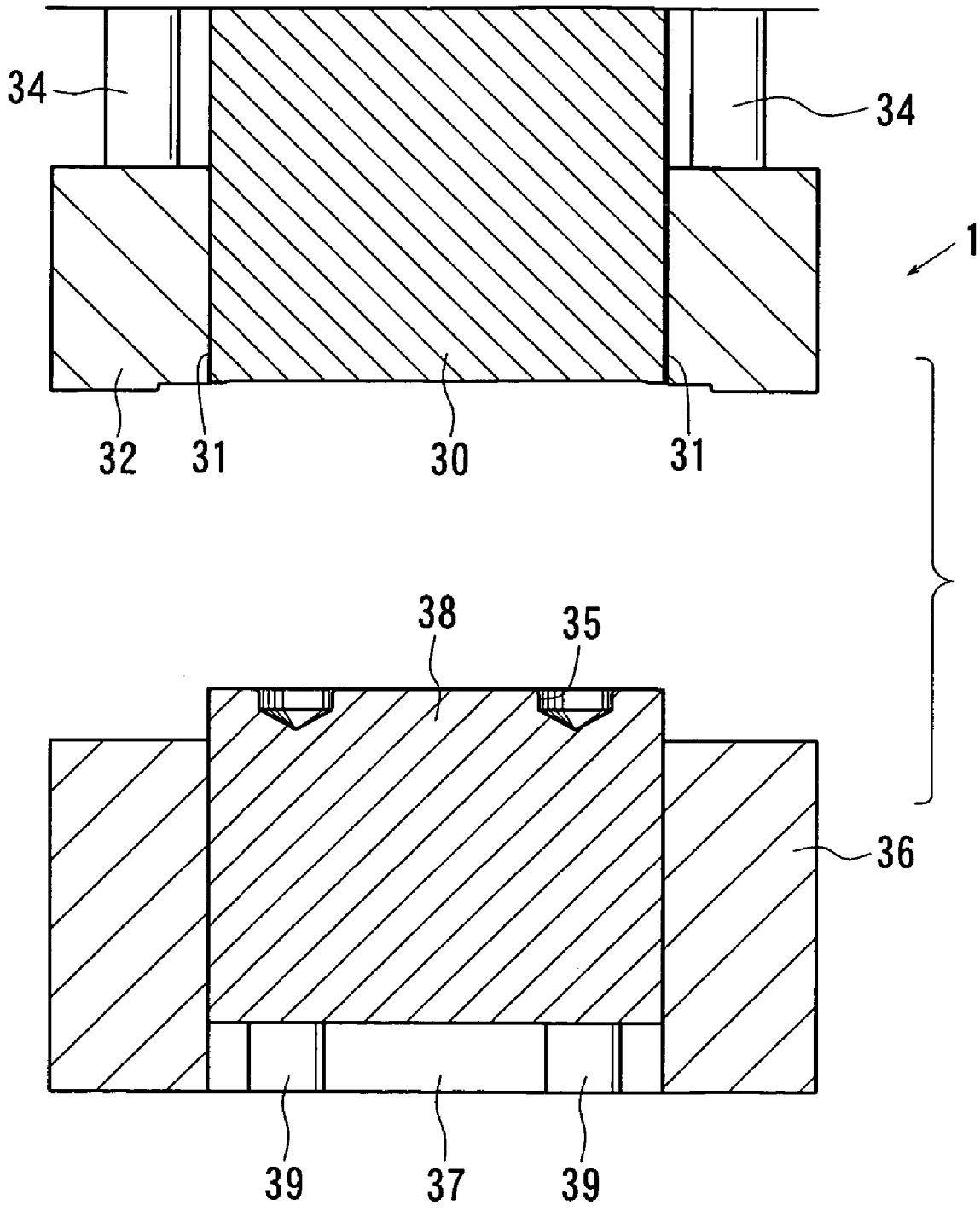
FIG. 2 is a vertical, cross-sectional view of first upper and lower dies for manufacturing the initial recessed plate, illustrating a condition in which the first upper and lower dies are opened.
Figure 3:
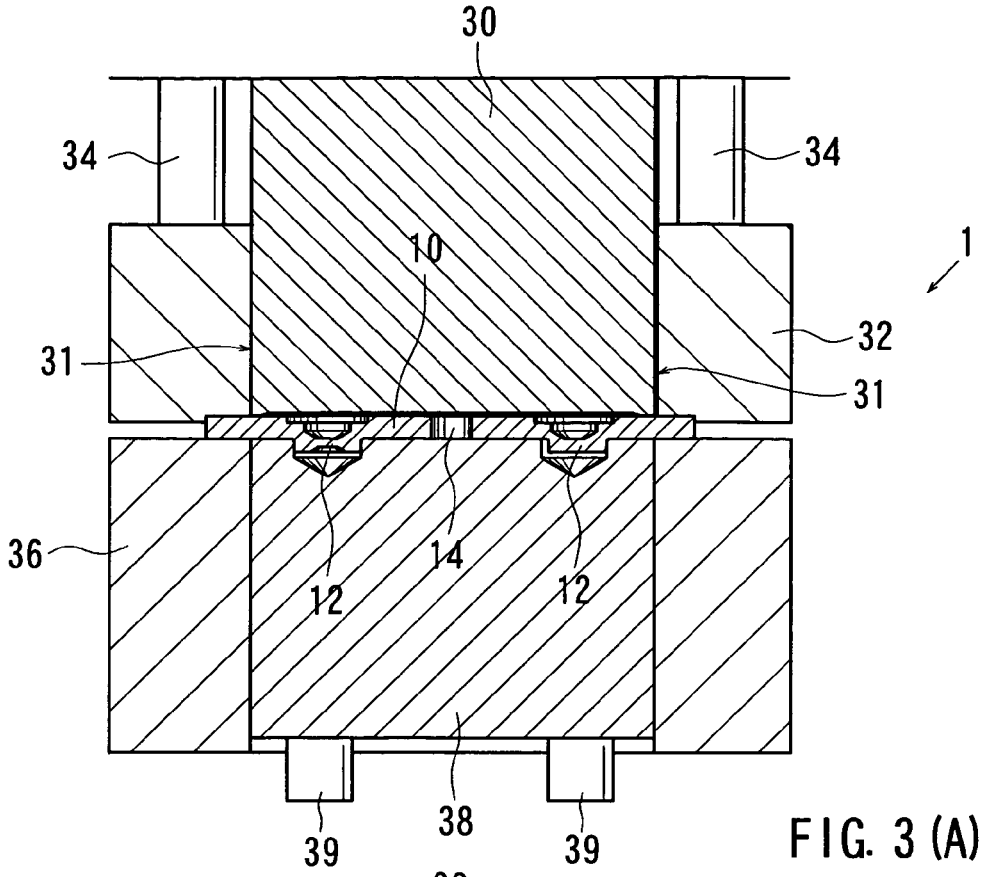
FIG. 3(A) is a vertical, cross-sectional view of the first upper and lower dies, illustrating a condition in which a sheet material is disposed between the first upper and lower dies.
FIG. 3(B) is a vertical, cross-sectional view of the first upper and lower dies, illustrating a condition in which the sheet material is press formed in order to form the intermediate recessed plate.
Figure 3:
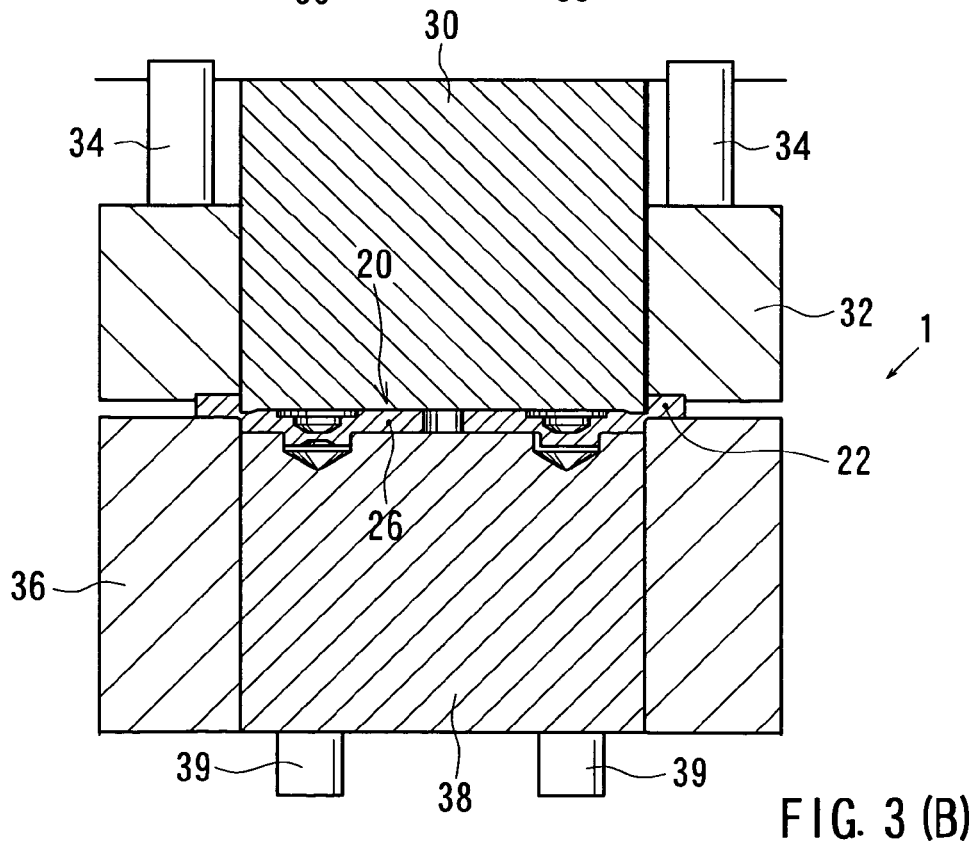

The initial recessed plate 20 may be formed by utilizing a press forming device 1 (FIG. 2). Thereafter, the intermediate recessed plate 20 is preferably subsequently processed by utilizing a reverse squeezing device 100 (FIG. 5), a squeezing device 200 (FIG. 8), a finishing device 300 (FIG. 11) and a restriking or coining device 400 (FIG. 14), to thereby form the final recessed plate 420.

As shown in FIGS. 2, 3(A) and 3(B), the press forming device 1 for producing the initial recessed plate 20 may include an upper die assembly that can move with respect to a lower die assembly. The upper die assembly may include an upper die or clamp ring 32 and a punch 30 that is movably disposed within the clamp ring 32. Preferably, the punch 30 can move relative to the clamp ring 32 in the vertical direction (i.e., in the parallel direction), as shown in FIGS. 3(A) and 3(B). For example, the clamp ring 32 may be coupled to a plurality of hydraulically controlled pressure pins 34 so as to be normally biased or forced downwardly. The punch 30 may be coupled to a hydraulic cylinder (not shown) so as to independently move toward and away from the lower die assembly. Further, the punch 30 is preferably profiled so as to have substantially the same shape as the recess R1 that will be formed within the intermediate recessed plate 20. In addition, tooth forming edges 31 may be disposed around the circumference of the punch 30. The tooth forming edges 31 preferably correspond to opposing toothed portions 24 that will be formed along the inner circular surface 22*a* of the peripheral flange 22.

The lower die assembly may include an annular lower die 36 having a die opening 37 that preferably corresponds to the profile of the punch 30. The lower die assembly may further include an ejector 38 that is closely and movably received within the die opening 37. The ejector 38 may be coupled to a plurality of hydraulically controlled pressure pins 39 so as to be upwardly biased or forced. Preferably, the ejector 38 is designed so as to be normally upwardly projected from the lower die 36. Further, the ejector 38 is formed with a plurality of recesses 35 that can receive the dwells 12 of the sheet material 10.

Figure 5:
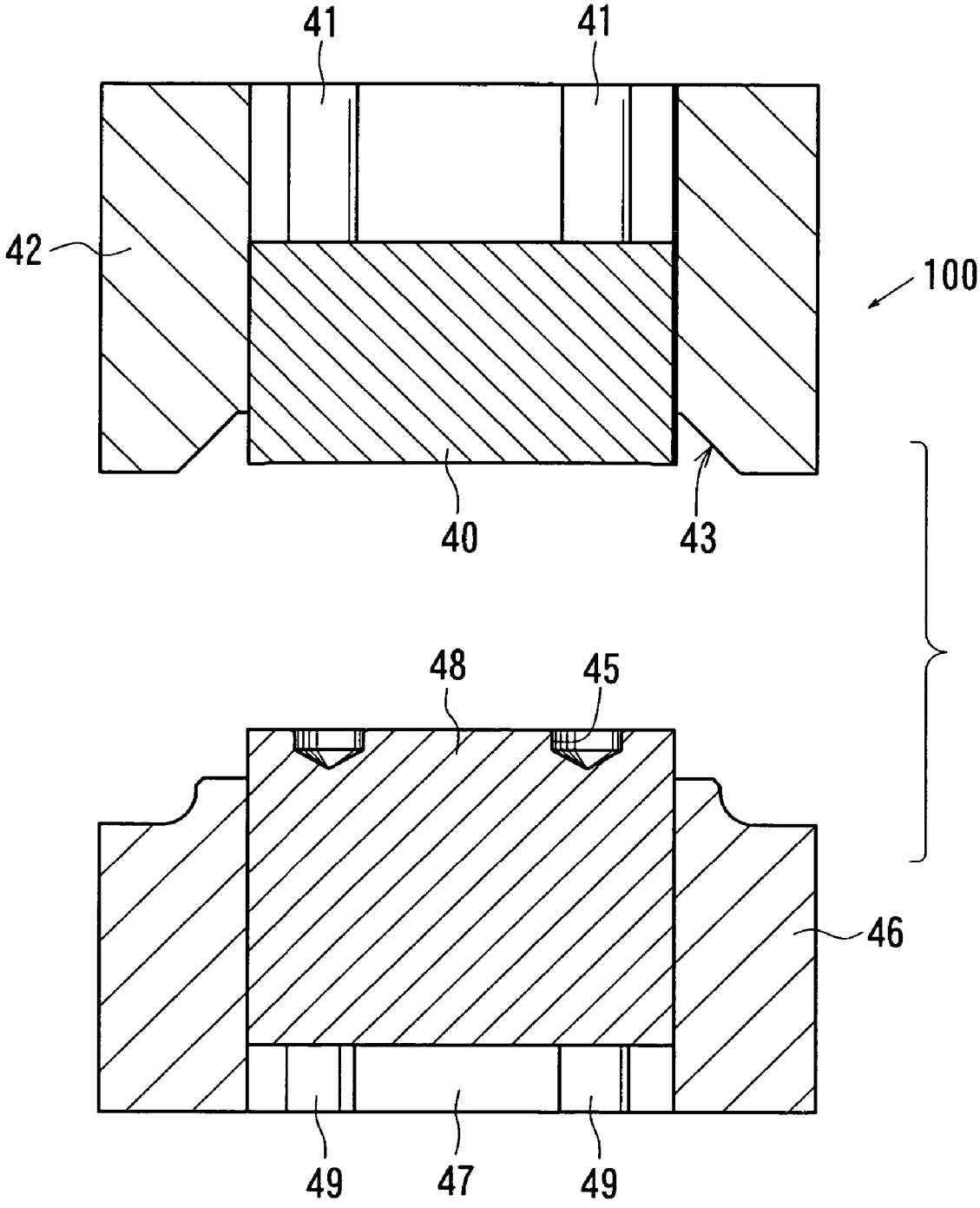
FIG. 5 is a vertical, cross-sectional view of second upper and lower dies for manufacturing the first intermediate recessed plate, illustrating a condition in which the second upper and lower dies are opened.
Figure 6:
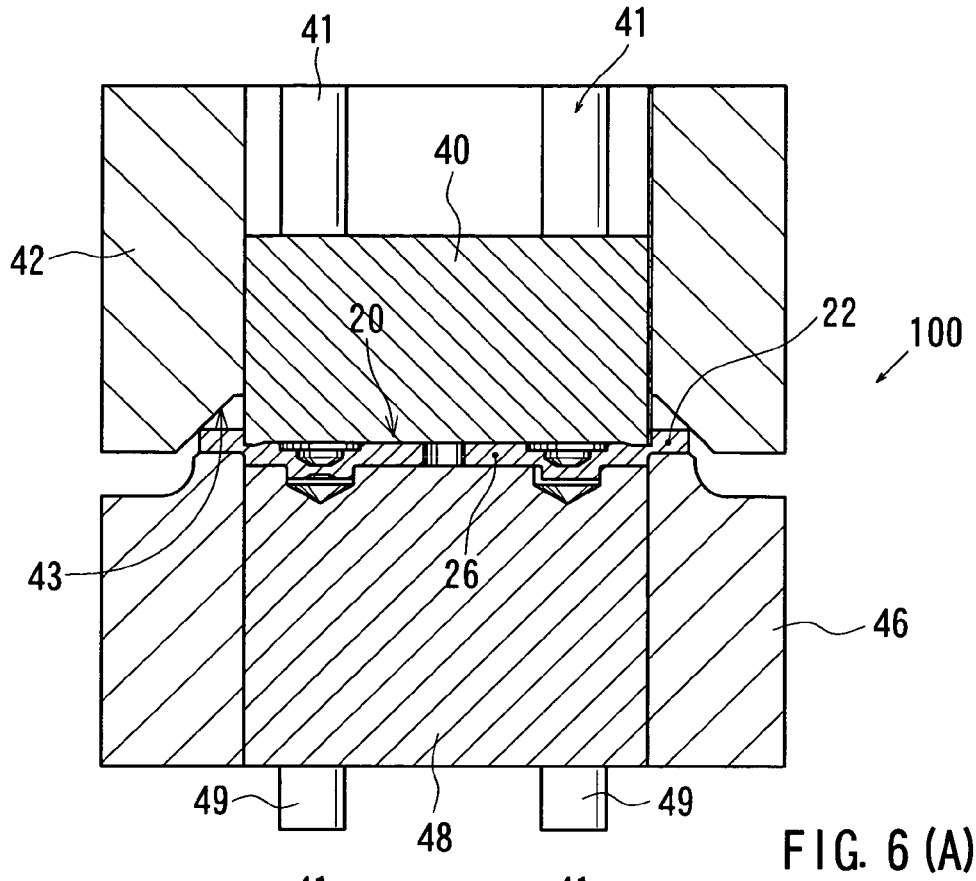
FIG. 6(A) is a vertical, cross-sectional view of the second upper and lower dies, illustrating a condition in which the initial recessed plate is disposed between the second upper and lower dies.
FIG. 6(B) is a vertical, cross-sectional view of the second upper and lower dies, illustrating a condition in which the initial recessed plate is press formed in order to form the first intermediate recessed plate.
Figure 6:
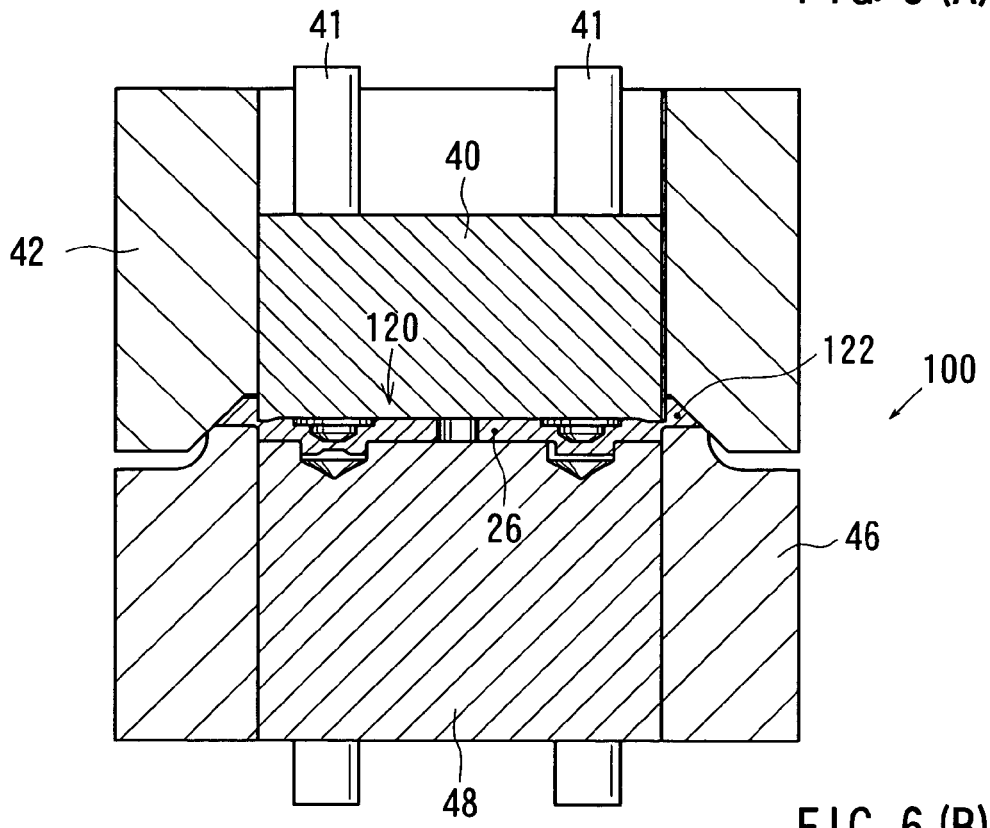

As shown in FIGS. 5, 6(A) and 6(B), the reverse squeezing device 100 for producing the first intermediate recessed plate 120 may include an upper die assembly that can move with respect to a lower die assembly. The upper die assembly may include a retainer 40 and an upper die or reverse squeezing punch (i.e., a reverse squeezing member) 42 that is movably disposed around the retainer 40. Preferably, the punch 42 can move relative to the retainer 40 in the vertical direction (i.e., in the parallel direction), as shown in FIGS. 6(A) and 6(B). For example, the retainer 40 may be coupled to a plurality of hydraulically controlled pressure pins 41 so as to be normally biased or forced downwardly. The punch 42 may be coupled to a hydraulic cylinder (not shown) so as to independently move toward and away from the lower die assembly. Further, the punch 42 is preferably formed with an annular tapered surface or reverse squeezing surface 43. As will be appreciated, the reverse squeezing surface 43 may preferably be flared downwardly.

The lower die assembly may include an annular lower die 46 having a die opening 47. The lower die assembly may further include an ejector 48 that is closely and movably received within the die opening 47. The ejector 48 may be coupled to a plurality of hydraulically controlled pressure pins 49 so as to be upwardly biased or forced. Preferably, the ejector 48 is designed so as to be normally upwardly projected from the lower die 46. Further, the ejector 48 is formed with a plurality of recesses 45 that can receive the dwells 12 of the initial recessed plate 20.

Figure 8:
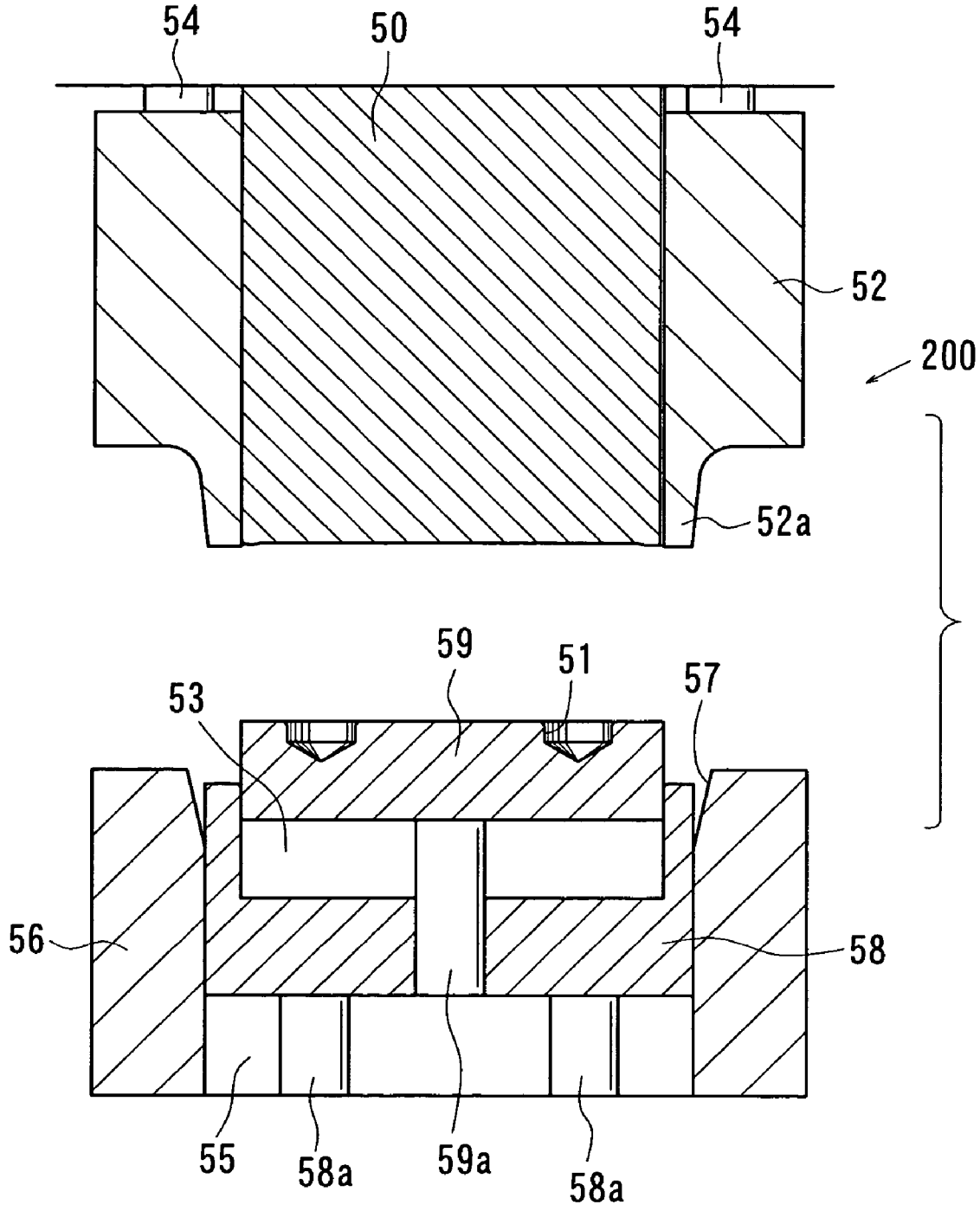
FIG. 8 is a vertical, cross-sectional view of third upper and lower dies for manufacturing the second intermediate recessed plate, illustrating a condition in which the third upper and lower dies are opened.
Figure 9:
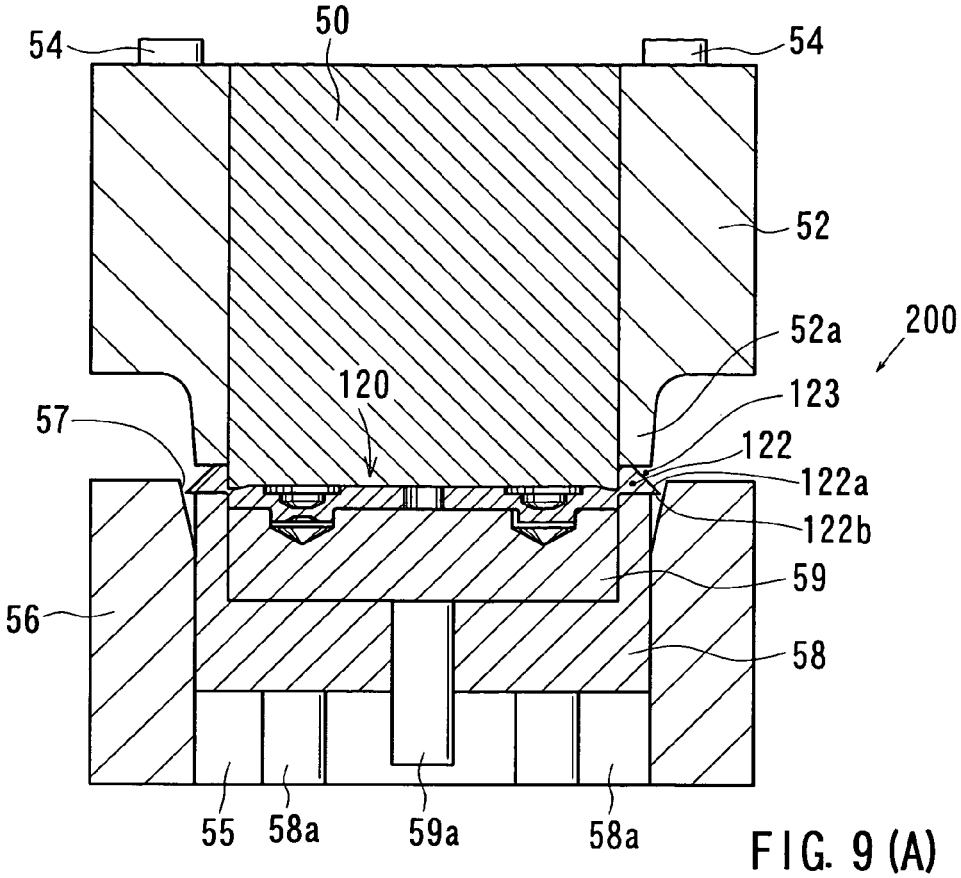
FIG. 9(A) is a vertical, cross-sectional view of the third upper and lower dies, illustrating a condition in which the first intermediate recessed plate is disposed between the third upper and lower dies.
FIG. 9(B) is a vertical, cross-sectional view of the third upper and lower dies, illustrating a condition in which the first intermediate recessed plate is squeezed in order to form the second intermediate recessed plate.
Figure 9:
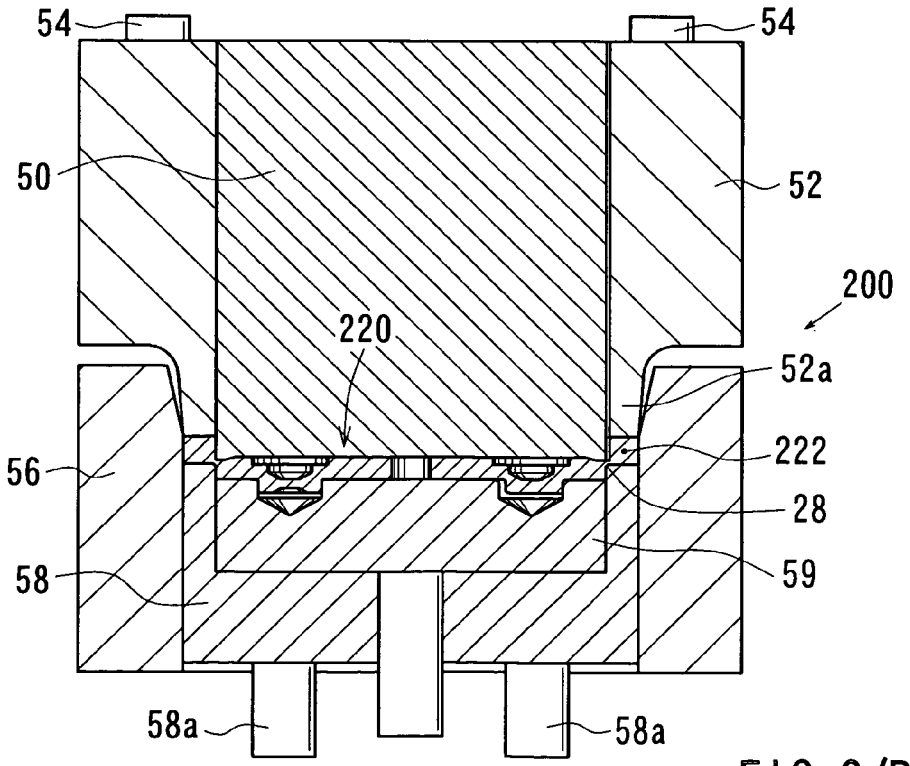

As shown in FIGS. 8, 9(A) and 9(B), the squeezing device 200 for producing the second intermediate recessed plate 220 also may include an upper die assembly that can move with respect to a lower die assembly. The upper die assembly may include an upper die or clamp ring 52 (i.e., a restraint die) and a retainer 50 that is movably disposed within the clamp ring 52. Preferably, the retainer 50 can move with respect to the clamp ring 52 in the vertical direction (i.e., in the parallel direction), as shown in FIGS. 9(A) and 9(B). The clamp ring 52 may be coupled to a plurality of hydraulically controlled pressure pins 54 so as to be downwardly biased. Also, the clamp ring 52 may include a lower leading end portion 52*a*, which portion 52*a* preferably has substantially the same outer diameter as the peripheral flange 222 of the second intermediate recessed plate 220. The retainer 50 may be coupled to a hydraulic cylinder (not shown) so as to be normally biased or forced downwardly.

Still referring to FIGS. 8, 9(A) and 9(B), the lower die assembly may include an annular-shaped lower die 56 (i.e. a squeezing member) having a die opening 55 that may preferably correspond to the profile of the clamp ring leading end portion 52*a*. In addition, the upper periphery of the die opening 55 may be upwardly flared. As a result, an annular-shaped tapered (chamfered) guide surface 57 is defined around the upper periphery of the die opening 55. The lower die assembly may further include a pad or piston 58 (i.e., a restraint die) that is closely and movably received within the die opening 55. The piston 58 may be coupled to a plurality of hydraulically controlled pressure pins 58*a* so as to be upwardly biased or forced. The piston 58 preferably has substantially the same outer diameter as the lower leading end portion 52*a* of the clamp ring 52. The piston 58 also may include a upper depressed portion 53. Also, the lower die assembly may further include an ejector 59 that is closely and movably received within the depressed portion 53 of the piston 58. The ejector 59 may be coupled to a hydraulically controlled pressure pin 59*a* so as to be upwardly biased or forced. Further, the ejector 59 is formed with a plurality of recesses 51 that can receive the dwells 12 of the first intermediate recessed plate 120.

Figure 11:
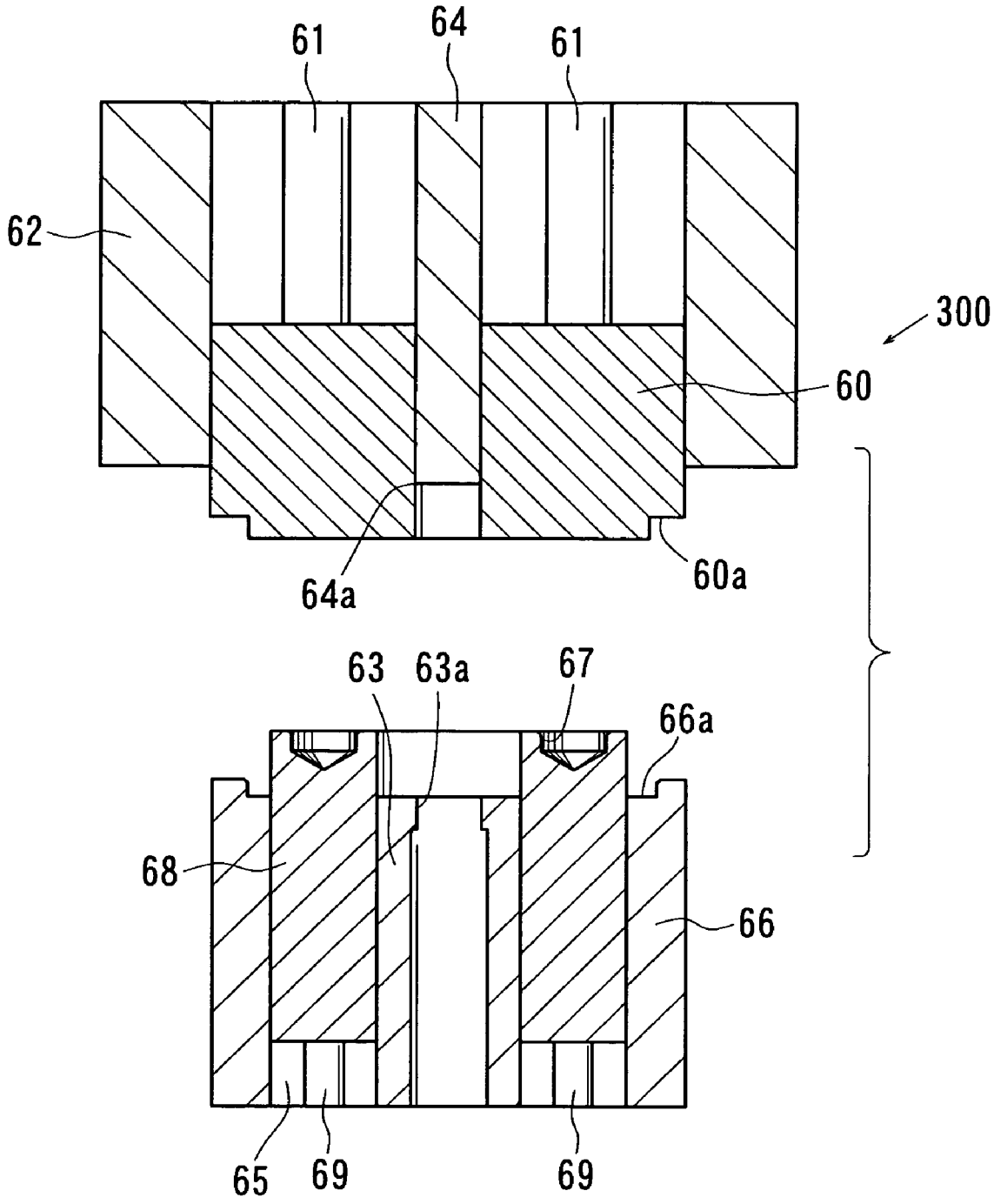
FIG. 11 is a vertical, cross-sectional view of fourth upper and lower dies for manufacturing the third intermediate recessed plate, illustrating a condition in which the fourth upper and lower dies are opened.
Figure 12:
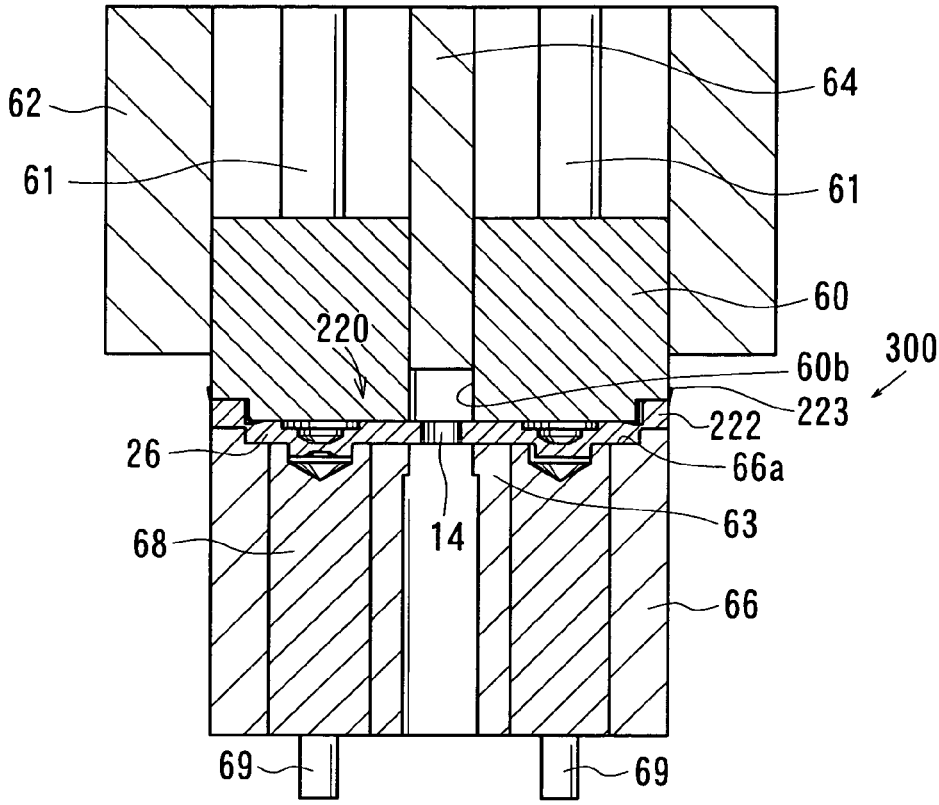
FIG. 12(A) is a vertical, cross-sectional view of the fourth upper and lower dies, illustrating a condition in which the second intermediate recessed plate is disposed between the fourth upper and lower dies.
FIG. 12(B) is a vertical, cross-sectional view of the fourth upper and lower dies, illustrating a condition in which the second intermediate recessed plate is press formed in order to form the third intermediate recessed plate.
Figure 12:
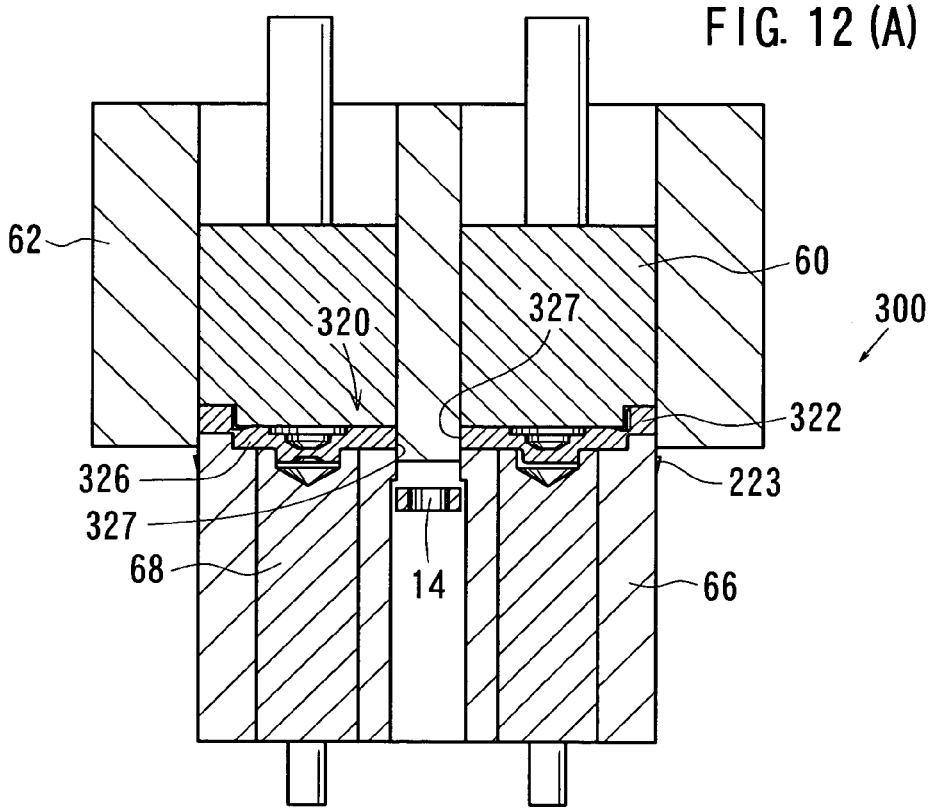

As shown in FIGS. 11, 12(A) and 12(B), the finishing device 300 for producing the third intermediate recessed plate 320 may include an upper die assembly that can move with respect to a lower die assembly. The upper die assembly may include a retainer 60 and an upper die or finishing punch 62 that is movably disposed around the retainer 60. Preferably, the punch 62 can move relative to the retainer 60 in the vertical direction (i.e., in the parallel direction), as shown in FIGS. 12(A) and 12(B). For example, the retainer 60 may be coupled to a plurality of hydraulically controlled pressure pins 61 so as to be normally biased or forced downwardly. Further, the retainer 60 is formed with an outer annular shoulder 60*a* that is shaped to engage the peripheral flange 222 of the second intermediate recessed plate 220. The punch 62 may be coupled to a hydraulic cylinder (not shown) so as to independently move toward and away from the lower die assembly. The upper die assembly may further include a punching pin 64 having a punching edge 64*a* that is closely and movably received within a central bore 60*b* formed in the retainer 60. The punching pin 64 may be coupled to a hydraulic cylinder (not shown) so as to move toward and away from the lower die assembly.

The lower die assembly may include an annular lower die 66 having an annular die opening 65. The lower die 66 is formed with an inner annular shoulder 66*a* that is shaped to engage the central body 26 of the second intermediate recessed plate 220. As will be appreciated, the lower die 66 may substantially have the same diameter as the retainer 60 of the upper die assembly. The lower die assembly may further include an annular ejector 68 that is closely and movably received within the die opening 65. The ejector 68 may be coupled to a plurality of hydraulically controlled pressure pins 69 so as to be upwardly biased or forced. Preferably, the ejector 68 is designed so as to be normally upwardly projected from the lower die 66. Further, the ejector 68 is formed with a plurality of recesses 67 that can receive the dwells 12 of the second intermediate recessed plate 220. In addition, the lower die 66 may include a cylindrical punching element 63 that is integrally formed therein. The punching element 63 is formed with a circular punching edge 63*a* that can closely receive the punching edge 64*a* of the punching pin 64.

Figure 14:
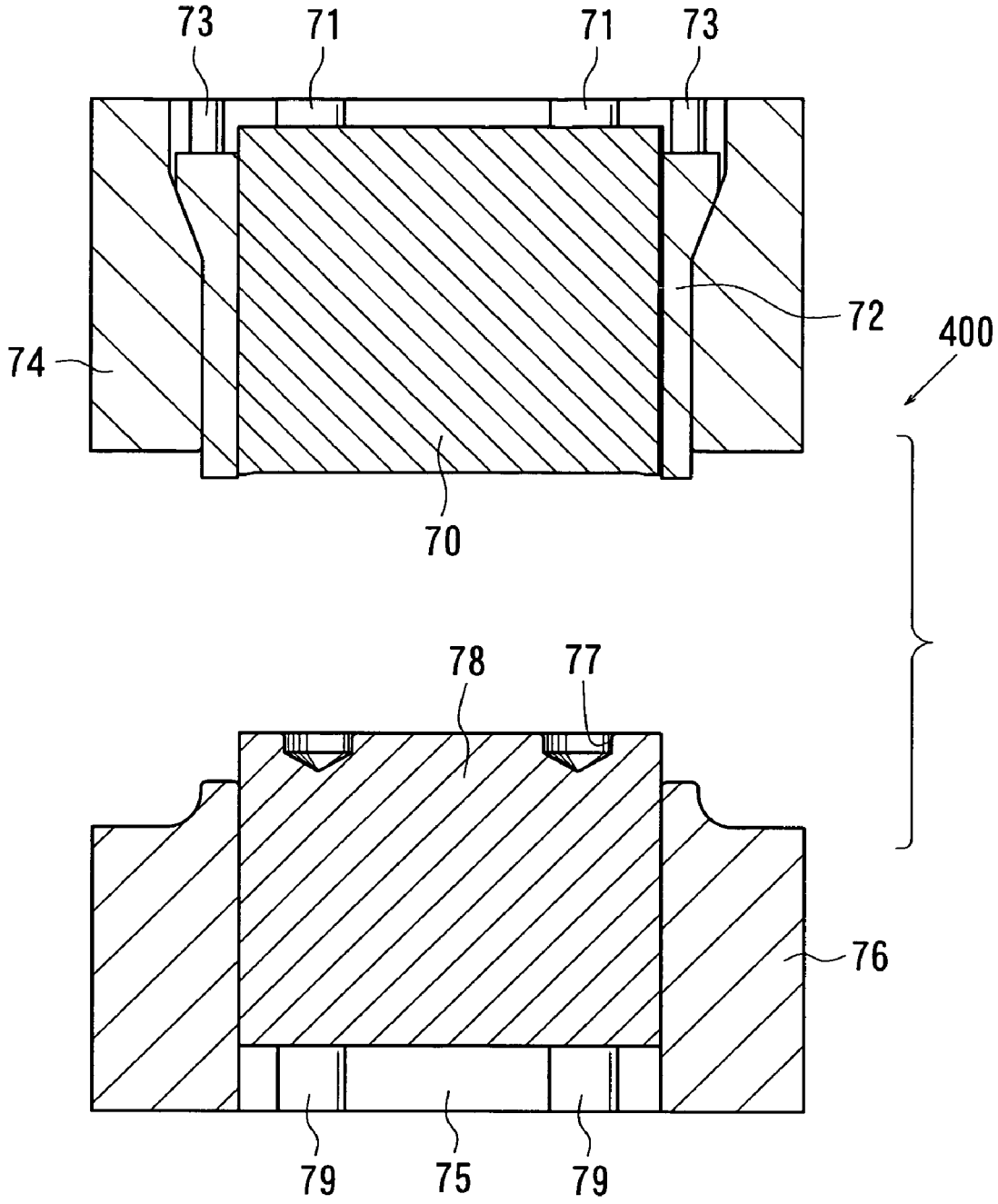
FIG. 14 is a vertical, cross-sectional view of fifth upper and lower dies for manufacturing the final recessed plate, illustrating a condition in which the fifth upper and lower dies are opened.
Figure 15:
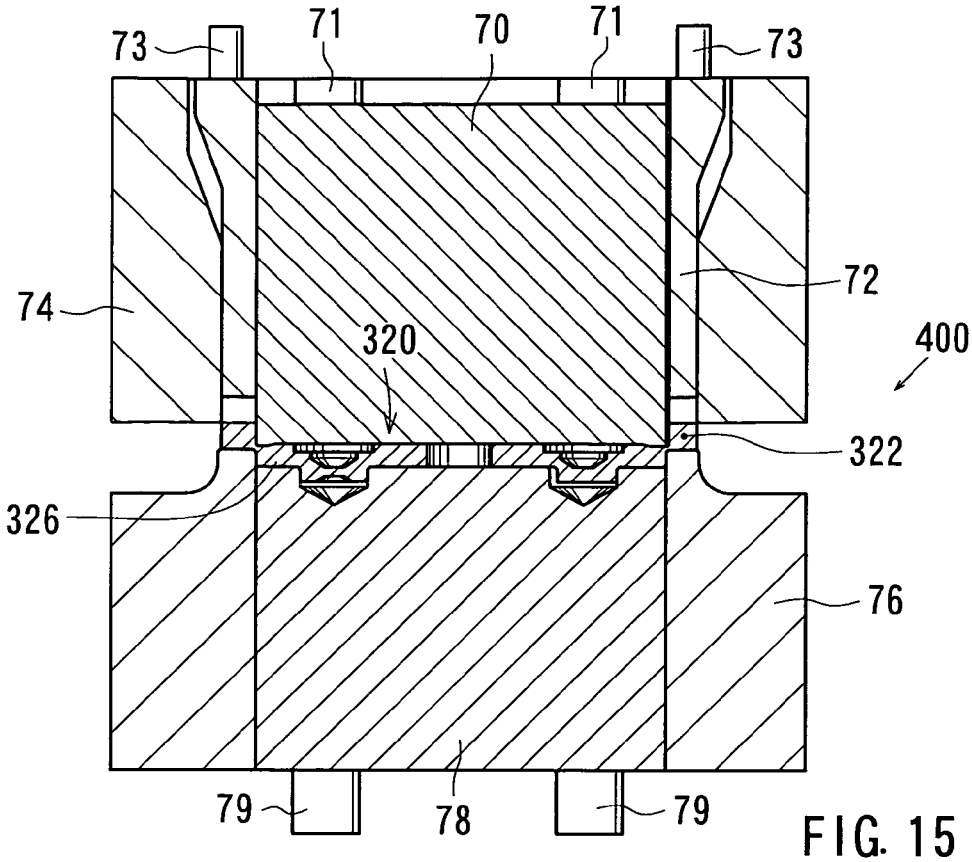
FIG. 15(A) is a vertical, cross-sectional view of the fifth upper and lower dies, illustrating a condition in which the third intermediate recessed plate is disposed between the fifth upper and lower dies.
FIG. 15(B) is a vertical, cross-sectional view of the fifth upper and lower dies, illustrating a condition in which the third intermediate recessed plate is press formed in order to form the final recessed plate.
Figure 15:
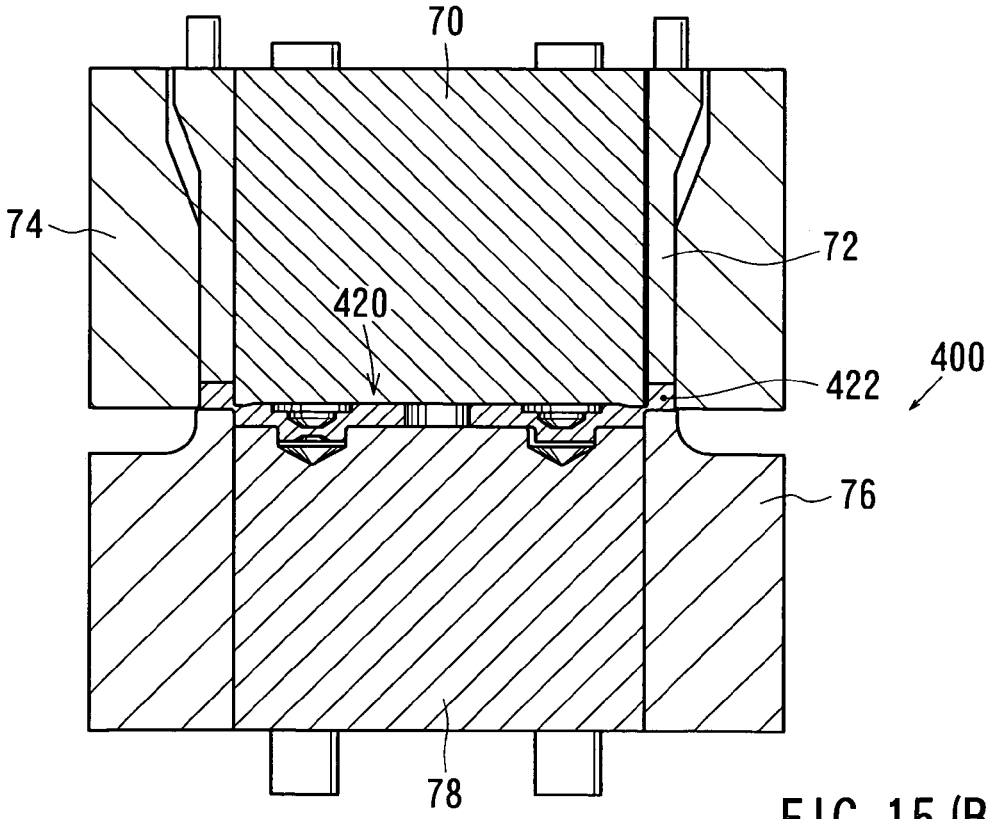

As shown in FIGS. 14, 15(A) and 15(B), the restriking device 400 for producing the final recessed plate 420 may include an upper die assembly that can move with respect to a lower die assembly. The upper die assembly may include an upper die or clamp ring 74, an annular punch 72 that is movably disposed within the clamp ring 74, and a retainer 70 that is movably disposed within the annular punch 72. Preferably, the clamp ring 74, the punch 72 and the retainer 70 can move relative to each other in the vertical direction (i.e., in the parallel direction), as shown in FIGS. 15(A) and 15(B). For example, the retainer 70 may be coupled to a plurality of hydraulically controlled pressure pins 71 so as to be normally biased or forced downwardly. The punch 72 may be coupled to shafts 73 connected to a hydraulic cylinder (not shown) so as to independently move toward and away from the lower die assembly. Similarly, the clamp ring 74 may be coupled to a hydraulic cylinder (not shown) so as to independently move toward and away from the lower die assembly.

The lower die assembly may include an annular lower restriking die 76 having a die opening 75. The lower die assembly may further include an ejector 78 that is closely and movably received within the die opening 75. The ejector 78 may be coupled to a plurality of hydraulically controlled pressure pins 79 so as to be upwardly biased or forced. Preferably, the ejector 78 is designed so as to be normally upwardly projected from the lower die 76. Further, the ejector 78 is formed with a plurality of recesses 77 that can receive the dwells 12 of the third intermediate recessed plate 320.

A representative method for manufacturing the recessed plate 420 using the devices 1, 100, 200, 300 and 400 will now be described.

As shown in FIG. 3(A), a circular sheet material 10 is first disposed on the ejector 38 of the lower die assembly of the press forming device 1 such that the dwells 12 formed in the sheet material 10 engage the recesses 35 of the ejector 38. Subsequently, the upper die assembly is lowered so that the periphery of the sheet material 10 is clamped between the lower die 36 and the clamp ring 32 of the upper die assembly.

As shown in FIG. 3(B), the punch 30, which is movably received within the clamp ring 32, is then extended (e.g., lowered) toward the die opening 37 defined within the lower die 36. As a result, the sheet material 10 is shear press formed or half die cut, to thereby form the initial recessed plate 20 as the primary product. Further, when the sheet material 10 is press formed, the toothed portions 24 are simultaneously formed along the inner circular surface 22*a* of the peripheral flange 22, because tooth forming edges 31 are defined around the circumference of the punch 30.

Because the ejector 38 is upwardly biased or forced during the press forming step, the punch 30 will be lowered against the upward reactive force of the ejector 38. Further, the punch 30 is preferably controlled in order to be lowered a predetermined distance so that the connecting portion 28 will have the desired thickness. That is, persons skilled in the art can easily determine the predetermined distance for lowering the punch 30 in order to appropriately define the circular recess R1.

After completing the press forming operation, the punch 30 is retracted or withdrawn and then the upper die assembly is lifted or removed. As a result, the ejector 38 will be upwardly returned to its resting position due to the hydraulic force of the pressure pins 39. Thus, the initial recessed plate 20 will be ejected from the die opening 37 of the lower die 36.

The initial recessed plate 20 thus formed comprises the central circular depressed body 26 and the peripheral flange 22 that are interconnected via the annular connecting portion 28. At this time, the circular body 26 and the peripheral flange 22 will have substantially the same thickness as the sheet material 10. The initial recessed plate 20 also includes the circular recess R1 that is defined by the peripheral flange 22 and the central body 26. In addition, two toothed portions 24 are formed around the inner circular surface 22*a* of the peripheral flange 22.

The initial recessed plate 20 is then processed by utilizing the reverse squeezing device 100. That is, as shown in FIG. 6(A), the initial recessed plate 20 is placed or seated on the ejector 48 of the lower die assembly such that the dwells 12 engage the recesses 45 of the ejector 48. Subsequently, the upper die assembly is lowered so that the central body 26 of the initial recessed plate 20 is clamped between the retainer 40 and the ejector 48. At this time, the peripheral flange 22 of the initial recessed plate 20 is seated on the lower die 46.

As shown in FIG. 6(B), the reverse squeezing punch 42 is then extended (e.g., lowered) toward the lower die 46. As a result, the peripheral flange 22 of the initial recessed plate 20 will be vertically reverse squeezed or compressed by the reverse squeezing surface 43 of the punch 42, to thereby form the first intermediate recessed plate 120 as the secondary product.

After completing the reverse squeezing operation, the punch 42 is retracted or withdrawn and then the upper die assembly is lifted or removed. As a result, the ejector 48 will be upwardly returned to its resting position due to the hydraulic force of the pressure pins 49. Thus, the first intermediate recessed plate 120 will be ejected from the lower die assembly.

The first intermediate recessed plate 120 thus formed may comprise the central body 26 and the annular peripheral flange 122 having the outer inclined circumferential surface 122*a*. Typically, at this time, part of the peripheral flange 122 may be thickened so as to have a thickness greater than that of the peripheral flange 22 of the initial recessed plate 20. Simultaneously, part of the peripheral flange 122 may be thinned so as to have a thickness smaller than that of the peripheral flange 22 of the initial recessed plate 20. Also, the height of the toothed portions 124 will be higher than that of the toothed portion 24 of the initial recessed plate 20.

The first intermediate recessed plate 120 is then processed by utilizing the squeezing device 200. That is, as shown in FIG. 9(A), the first intermediate recessed plate 120 is placed or seated on the ejector 59 of the lower die assembly such that the dwells 12 engage the recesses 51 of the ejector 59. Subsequently, the upper die assembly is lowered so that the central body 26 of the first intermediate recessed plate 120 is clamped between the retainer 50 and the ejector 59. At this time, the ejector 59 is retracted in the depressed portion 53 of the piston 58 and the peripheral flange 122 is also clamped between the lower leading end portion 52*a* of the clamp ring 52 and the piston 58. That is, the peripheral flange 122 is restrained vertically by the lower leading end portion 52*a* of the clamp ring 52 and the piston 58. As shown in FIG. 9(A), the peripheral flange 122 preferably projects or extends radially outwardly from the clamp ring end portion 52*a* and the piston 58. In this case, an annular extending portion 122*b* will be defined around the peripheral flange 122. Further, an annular space 123 will be defined between the clamp ring end portion 52*a* and the peripheral flange inclined surface 122*a*.

Thereafter, as shown in FIG. 9(B), the upper die assembly is further moved (e.g., lowered) toward the lower die assembly. Thus, the clamp ring end portion 52*a* and the retainer 50 will be pushed into the die opening 55 together with the piston 58 and the ejector 59 against the hydraulic force of the pressure pins 58*a*. At this time, the clamped first intermediate recessed plate 120 is also pushed into the die opening 55 via the guide surface 57. Consequently, the annular extending portion 122*b* of the peripheral flange 122 will be radially inwardly (laterally) squeezed or compressed by the guide surface 57 so as to radially inwardly move or migrate as a result of plastic flow caused by plastic deformation. As a result, the peripheral flange 122 may preferably be deformed so as to fill up the annular space 123. That is, the peripheral flange 122 may preferably be deformed so that the inclined surface 122*a* disappears (i.e., transforms into a vertical and horizontal surfaces). Thus, the second intermediate recessed plate 220 having the thickened peripheral flange 222 is produced as the tertiary product. Further, as described above, the peripheral flange 222 may be formed with the small flashes 223 around the upper circumferential periphery thereof.

As will be recognized, because the annular space 123 is defined between the clamp ring end portion 52*a* and the peripheral flange inclined surface 122*a*, the peripheral flange 122 can be easily and reliably deformed. In other words, the peripheral flange annular extending portion 122*b* will effectively radially inwardly move by plastic deformation without excessively squeezing out. As a result, the peripheral flange 122 can be substantially completely converted to the peripheral flange 222.

Further, the clamp ring 52 is downwardly forced by means of the pressure pins 54 and the piston 58 and the ejector 59 are respectively upwardly forced by means of the pressure pins 58*a* and 59*a*. As a result, during the squeezing operation, the first intermediate recessed plate 120 can be appropriately supported in the squeezing device 200. Therefore, the first intermediate recessed plate 120 can be effectively prevented from bending, e.g., at the connecting portion 28. As will be recognized, the pressure pins 54 may preferably be controlled such that the clamp ring 52 can be appropriately retracted (i.e., moved upwardly) when the peripheral flange 122 is deformed or thickened.

After completing the squeezing operation, the upper die assembly is lifted or removed. As a result, the piston 58 will be upwardly returned to its resting position due to the hydraulic force of the pressure pins 58*a* and then the ejector 59 is upwardly returned due to the hydraulic force of the pressure pin 59*a*. Thus, the second intermediate recessed plate 220 will be ejected from the lower die assembly.

The second intermediate recessed plate 220 thus formed may comprise the central body 26 and the annular peripheral flange 222 having the flashes 223. Typically, at this time, the thickness of the peripheral flange 222 will be greater than that of the peripheral flange 122 of the first intermediate recessed plate 120.

The second intermediate recessed plate 220 is then processed by utilizing the finishing device 300. That is, as shown in FIG. 12(A), the second intermediate recessed plate 220 is placed or seated on the ejector 68 of the lower die assembly such that the dwells 12 engage the recesses 67 of the ejector 68. Subsequently, the upper die assembly is lowered so that the central body 26 of the second intermediate recessed plate 220 is clamped between the retainer 60 and the annular shoulder 66*a* of the lower die 66. At this time, the peripheral flange 222 is also clamped between the annular shoulder 60*a* of the retainer 60 and the lower die 66.

As shown in FIG. 12(B), the finishing punch 62 is then extended (e.g., lowered) toward the lower die 66. As a result, the peripheral flange 222 of the second intermediate recessed plate 220 is preferably circumferentially finished or processed by the punch 62 so that the flashes 223 are cut off or removed from the peripheral flange 222. Simultaneously, the punching pin 64 is extended (e.g., lowered) toward the punching element 63 so as to form the central through bore 327 in the central body 26. Thus, the third intermediate recessed plate 320 is formed as the quaternary product.

After completing the finishing operation, the punch 62 and the punching pin 64 are retracted or withdrawn and then the upper die assembly is lifted or removed. As a result, the ejector 68 will be upwardly returned to its resting position due to the hydraulic force of the pressure pins 69. Thus, the third intermediate recessed plate 320 will be ejected from the lower die assembly.

The third intermediate recessed plate 320 thus formed may comprise the central body 326 and the annular peripheral flange 322. At this time, the thickness of the peripheral flange 322 will be substantially identical with that of the peripheral flange 222 of the second intermediate recessed plate 220.

This finishing operation is an optional operation and not an essential operation. Therefore, this operation can be omitted, if necessary. If the finishing operation is omitted, the punching operation for forming the central through bore 327 can preferably be performed during any other operations.

The third intermediate recessed plate 320 is then processed by utilizing the restriking device 400. That is, as shown in FIG. 15(A), the third intermediate recessed plate 320 is placed or seated on the ejector 78 of the lower die assembly such that the dwells 12 engage the recesses 77 of the ejector 78. Subsequently, the upper die assembly is lowered so that the central body 326 of the third intermediate recessed plate 320 is clamped between the retainer 70 and the ejector 78. At this time, the peripheral flange 322 is seated on the lower restriking die 76.

As shown in FIG. 15(B), the clamp ring 74 is then downwardly forced. As a result, the peripheral flange 322 is restrained radially by the retainer 70 and the clamp ring 74. Thereafter, the punch 72 is extended (e.g., lowered) toward the lower die 76. As a result, the peripheral flange 322 of the third intermediate recessed plate 320 is preferably restriked vertically between the punch 72 and the lower die 76. Thus, the final recessed plate 420 is formed.

After completing the restriking operation, the punch 72 and the clamp ring 74 are retracted or withdrawn and then the upper die assembly is lifted or removed. As a result, the ejector 78 will be upwardly returned to its resting position due to the hydraulic force of the pressure pins 79. Thus, the recessed plate 420 will be ejected from the lower die assembly.

The recessed plate 420 thus formed may comprise the central body 326 and the annular peripheral flange 422. At this time, the thickness of the peripheral flange 422 will be slightly smaller than that of the peripheral flange 322 of the third intermediate recessed plate 320.

Optionally, the recessed plate 420 thus formed may be further treated or processed (e.g., machining or heat treating) by utilizing one or more additional processing machines (not shown), to thereby produce a further finished product. In addition, the second and third intermediate recessed plates 222 and 322 also can be used as a final product, if necessary.

The present methods include the preliminary or reverse squeezing operation prior to the squeezing operation. Therefore, the squeezing operation can be effectively and reliably performed. As a result, it is possible to provide a flanged article superior in quality.

A representative example of the present invention has been described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

The invention claimed is:

1. A method for manufacturing an article having a thickened peripheral portion, comprising:

squeezing a first intermediate peripheral portion of a first intermediate article, to thereby form a second intermediate article having a second intermediate peripheral portion that is thickened, and reverse squeezing an initial peripheral portion of an initial article as a preliminary processing, to thereby form the first intermediate article, wherein the reverse squeezing step is performed in a direction opposite to the direction of the squeezing step wherein the reverse squeezing step comprises compressing the initial peripheral portion of the initial article in a direction of thickness of the article, to thereby form an inclined surface in the first intermediate peripheral portion so that the first intermediate peripheral portion has opposite surfaces of different area, and wherein the reverse squeezing step is performed, such that when the first intermediate peripheral portion of the first intermediate article is clamped between a pair of restraint dies in the squeezing step, a restraint surface of one of the restraint dies extends outwardly beyond one of opposite surfaces of the first intermediate peripheral portion.

2. A method as defined in claim 1, wherein the squeezing step comprises:

laterally compressing the first intermediate peripheral portion of the first intermediate article to thereby cause the inclined surface to transform into vertical and horizontal surfaces as a result of plastic flow caused by plastic deformation.

3. A method as defined in claim 1 further comprises:

press forming a sheet material to thereby form the initial article.

4. A method as defined in claim 1 further comprises:

finishing the second intermediate peripheral portion of the second intermediate article.

5. A method as defined in claim 1 further comprises:

restriking the second intermediate peripheral portion of the second intermediate article.

6. A method as defined in claim 1, wherein the reverse squeezing step comprises:

seating the initial peripheral portion on a lower die of a reverse squeezing device, and extending a reverse squeezing member of the reverse squeezing device toward the lower die so as to compress the initial peripheral portion.

7. A method as defined in claim 1, wherein the squeezing step further comprises:

clamping the first intermediate peripheral portion of the first intermediate article between upper and lower restraint dies of a squeezing device, such that at least a portion of the first intermediate peripheral portion extends outwardly therefrom, and pushing the upper and lower restraint dies into a squeezing member of the squeezing device together with the first intermediate article clamped therebetween so as to compress the first intermediate peripheral portion.

8. A method for manufacturing an article having a thickened peripheral portion, comprising:

half die cutting a sheet blank to form an initial article having an initial peripheral portion, seating the initial peripheral portion of the initial article on a lower die of a reverse squeezing device, extending a reverse squeezing member of the reverse squeezing device toward the lower die so as to compress the initial peripheral portion, thereby forming a first intermediate article having a first intermediate peripheral portion that is partly thinned, clamping the first intermediate peripheral portion of the first intermediate article between upper and lower restraint dies of a squeezing device, such that at least a portion of the first intermediate peripheral portion extends outwardly therefrom, and pushing the upper and lower restraint dies into a squeezing member of the squeezing device together with the first intermediate article clamped therebetween so as to compress the first intermediate peripheral portion, thereby forming a second intermediate article having a second intermediate peripheral portion that is thickened throughout.

* * * * *